US006546859B1

(12) United States Patent
Troncon et al.

(10) Patent No.: US 6,546,859 B1
(45) Date of Patent: Apr. 15, 2003

(54) PRINTING MACHINE WITH OBJECT SUPPORT INCLUDING OBJECT LIFTING MEANS, AND OBJECT SUPPORT FOR PRINTING MACHINE

(75) Inventors: Daniel Troncon, Noisy-le-Grand (FR); Fabrice Pottier, Chelles (FR)

(73) Assignee: Societe d'Exploitation des Machines Dubuit, Noisy le Grand (FR)

( * ) Notice: Subject to any disclaimer, the term of this patent is extended or adjusted under 35 U.S.C. 154(b) by 39 days.

(21) Appl. No.: 09/694,013

(22) Filed: Oct. 23, 2000

(30) Foreign Application Priority Data

Oct. 22, 1999 (FR) ..... 99 13211

(51) Int. Cl.[7] ..... B05C 17/06
(52) U.S. Cl. ..... 101/126; 101/35
(58) Field of Search ..... 101/5, 6, 28, 35, 101/41, 115, 126, 424.1

(56) References Cited

U.S. PATENT DOCUMENTS 4,389,156 A * 6/1983 Dennhardt et al. ..... 101/477
5,092,239 A * 3/1992 Bubley ..... 101/115
5,188,034 A * 2/1993 Iaccino et al. ..... 101/126
5,429,045 A 7/1995 Karlyn et al.
6,050,182 A * 4/2000 Arsenault et al. ..... 101/115
6,213,011 B1 * 4/2001 Dubuit ..... 101/35
6,269,529 B2 * 8/2001 Clark ..... 101/35

FOREIGN PATENT DOCUMENTS

FR 2 699 111 6/1994

* cited by examiner

*Primary Examiner*—Ren Yan
(74) *Attorney, Agent, or Firm*—Young & Thompson

(57) ABSTRACT

A printing machine including a plate adapted to rotate about its axis and carrying at its periphery a plurality of object supports having a top face which receives an object to be printed and workstations distributed circumferentially around the plate in line with the trajectory of the object supports, some of which are printing stations and others of which are treatment stations. At least one of the object supports includes a lifting system which raises the object relative to the top face of the object support. The lifting system is connected to a suction head which preserves the projecting position of the object corresponding to that it initially occupied on the object support. The lifting system preferably includes at least two tubes which slide through holes through the object support and the plate.

22 Claims, 4 Drawing Sheets

PRINTING MACHINE WITH OBJECT SUPPORT INCLUDING OBJECT LIFTING MEANS, AND OBJECT SUPPORT FOR PRINTING MACHINE

BACKGROUND OF THE INVENTION

1. Field of the Invention

The present invention relates generally to printing machines including a plate adapted to rotate about its axis and carrying at its periphery a plurality of object supports having a top face adapted to receive an object to be printed and a plurality of workstations distributed circumferentially around said plate in line with the trajectory of said object supports and some of which are printing stations and others of which are treatment stations.

2. Summary of the Invention

The invention provides a printing machine including a plate adapted to rotate about its axis and carrying at its periphery a plurality of object supports having a top face adapted to receive an object to be printed and a plurality of workstations distributed circumferentially around the plate in line with the trajectory of the object supports and some of which are printing stations and others of which are treatment stations, wherein at least one of the object supports includes lifting means adapted to raise the object relative to the top face of the object support.

This has the advantage that it facilitates some object treatment operations (see below).

The lifting means are advantageously connected to a suction head adapted to preserve the projecting position of the object corresponding to that it initially occupied on the object support.

The lifting means advantageously include at least one tube mounted to slide through holes through the object support and the plate.

The tube is preferably fastened at the bottom to a spacer fastened to a shoe adapted to cooperate slidingly with a guide rail fixed under the object support and passing through an opening in the plate.

To raise the object, the spacer is adapted to cooperate with fixed cam means carried by a frame of the machine having a lifting ramp and a raised position maintaining bearing surface.

Alternatively, the spacer is adapted to cooperate with the shoe of a lifting actuator and with a raised position maintaining bearing surface formed on the top of fixed cam means carried by a frame of the machine; as a safety feature the shoe includes a lifting ramp in case the actuator should break down.

The spacer advantageously cooperates with the cam means and/or the shoe via a roller.

The lifting means preferably include cam means and a lifting actuator and the width of the lifting ramp of the cam means is less than that of its position maintaining bearing surface whereby a cut-out is defined in which the shoe of the actuator slides.

A beneficial application of the above object supports is to the situation in which at least one of the treatment stations is a heat treatment station, in particular a high-temperature heat treatment station. In accordance with the invention, the object is raised at this treatment station in the direction of the heat source and the flow of heat, for drying the ink on the printed object, for example, has little effect on the object support itself or the plate, the object being treated being at a distance from them so they are not deformed by the heat, which would reduce the print quality.

In this type of application the end of the tube advantageously has an endpiece made from a material that is resistant to high temperatures, to prevent thermal conduction phenomena.

For improved thermal protection of the object support and the plate, the heat treatment station can be a high-temperature station at which there are two radially spaced screens defining a slot through which the tube passes in the raised position, the screens being halfway up the emergent travel of the tube.

A slot cover is advantageously adapted to cover the slot during phases in which there are no objects to be treated.

Another beneficial application of the above object supports is to the situation in which the objects must be turned over, for example to print both sides; in this case at least one workstation is an overturning station.

The overturning station advantageously includes a pallet associated with actuator means adapted to move the pallet vertically and radially and to turn it about an axis; the pallet has holding suction nozzles at the end.

The actuator means are adapted to insert the pallet radially into the space between the object support and the object when the object is raised by the lifting means.

The object supports are preferably adjustably mounted on the plate.

In a preferred embodiment of the invention the object support bears on a hollow rod which is externally screwthreaded and screwed into a screwthread of the plate and a screw screwed into the object support passes through the hollow rod.

The screwthread of the plate is advantageously an internal screwthread of a hollow screw surrounding the rod and screwed into the plate by means of a screwthread on its outside face.

In a preferred embodiment of the invention the lifting means comprise two sliding tubes.

The present invention also provides an object support for a printing machine having an object-receiving top face which includes lifting means for raising the object relative to its top face.

The lifting means advantageously have the features of the object support of the above printing machine.

To explain the invention more clearly, one embodiment of the invention, shown in the accompanying drawings, will now be described by way of purely illustrative and non-limiting example.

DETAILED DESCRIPTION OF THE PREFERRED EMBODIMENTS

Figure 1:
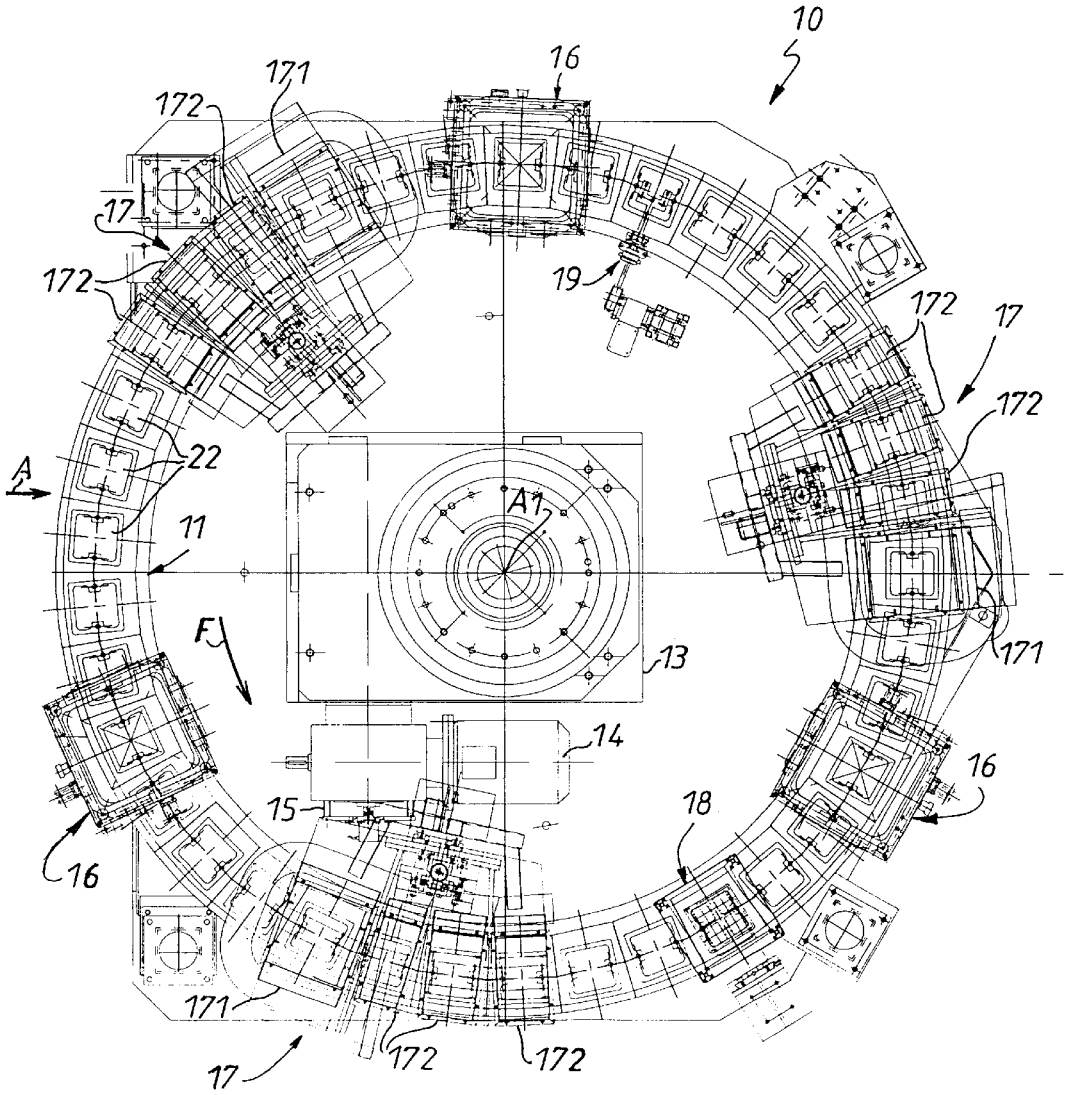
FIG. 1 is a plan view of a printing machine according to the invention.
Figure 2:
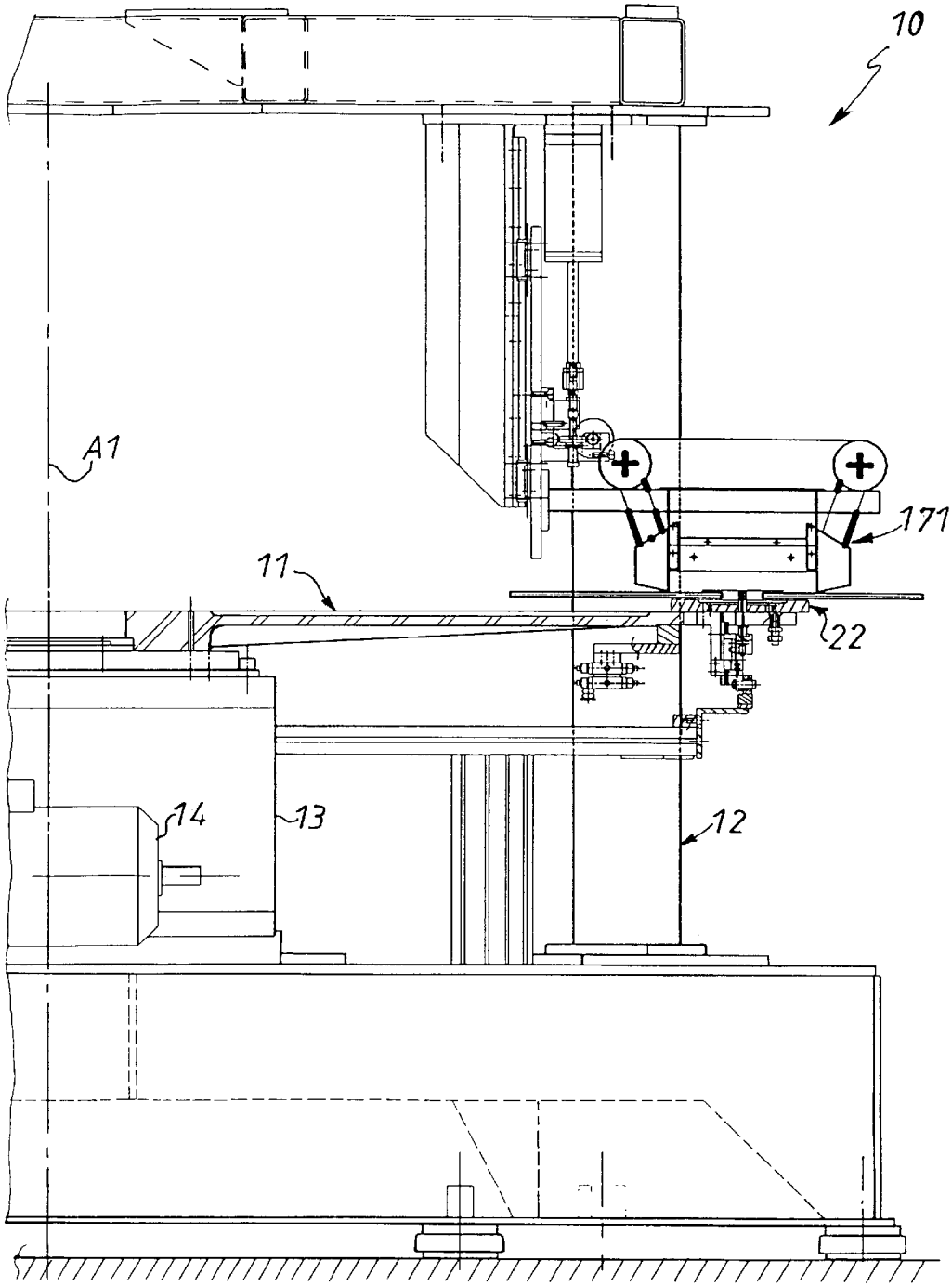
FIG. 2 is a half-view partly in section and to a larger scale of the machine from FIG. 1.

FIGS. 1 and 2 show a printing machine 10 which has a turret 11 which rotates about a vertical axis Al on a frame 12 and carries at its periphery a plurality of object supports 22. All this is known in the art. The turret 11 is simply a circular plate and is mounted on an indexing device 13 which is in turn mounted on the frame 12 and rotates the turret 11 stepwise.

The turret 11 is rotated by a motor 14 driving the indexing device 13 and conventionally associated with a gearbox 15.

Workstations, in particular printing and treatment stations, are arranged circumferentially around the turret 11, in line with the object supports 20.

In this example the turret 11 rotates in the direction of the arrow F (FIG. 1) and the machine includes three printing stations 16, three batteries 17 of heat treatment stations, a station 18 equipped with a video camera and an overturning station 19.

The printing machine 10 naturally includes a feed station, not shown, for feeding objects to be treated, in line with the arrow A in FIG. 1, and an offloading station just upstream of the feed station.

Each battery 17 of heat treatment stations includes a heating station 171 and three cooling stations 172.

The heating stations 171 are high-temperature ovens for drying printing inks deposited on the objects at the printing stations 16. The expression "high temperature" refers to temperatures above 100° C.; drying can be effected by means of infrared lamps or hot air, for example.

An object support 22, which can be seen more clearly in FIGS. 3 to 8, has a trapezium-shaped top face 23 (FIG. 8) with a rectilinear shorter parallel side 24 perpendicular to the radius of the turret or the plate 11 passing through its middle area, two lateral sides 25 extending along radii of the plate 11, and a curvilinear longer parallel side 26 concentric with the plate 10.

To receive an object 30 to be printed, for example a square booklet, the object support 22 has a recessed housing 27 in its top surface 23 with substantially the same contour as the object 30 and containing a support plate 40; the bottom of the housing 27 incorporates a recess 28 adapted to be connected to a suction system.

The support plate 40 is not indispensable, of course, and the object can be placed directly on the top face 23 of the object support 22.

If the machine incorporates a large number of stations, as is the case in the example described and shown, the plate 11 has a large diameter; it is then very difficult to achieve satisfactory flatness of the plate 11 perpendicularly to its rotation axis; to ensure that the levels of the surfaces of the thin and flat objects 30 to be printed are identical for all of the object supports 22, the position of the supports on the plate 11 can be adjusted perpendicularly to the plate; an arrangement of this kind is described in U.S. Pat. No. 5,402,718 in particular.

The object support 22 (FIG. 5) bears on an abutment washer 31 which rests on a centering washer 32 which rests on the end of a hollow rod 33 which has a hexagonal handling head 34 at its other end; the abutment washer 31 and the centering washer 32 cooperate through complementary frustoconical bearing surfaces which provide some degree of ball-joint action to allow for any non-parallelism of the top face of the object support 22 and the plate 11.

The rod 33 is externally screwthreaded and is screwed into an internal screwthread in the plate 11; the screwthread in the plate 11 is on the inside surface of a hollow screw 35 which surrounds the rod 33 and which is screwed into the plate 11 by means of a thread on its outside face.

The hollow screw 35 also has a handling head 36, which is also hexagonal; the hollow screw 35 acts in the manner of an insert relative to the plate 11; because the latter plate is large, it is made of a light material such as aluminum, and the internal thread with which the hollow rod 33 meshes is of steel.

A screw 37 passes through the hollow rod 33 and the washers 31 and 32 and is screwed into the object support 22. Its head is adapted to cooperate abutment fashion with the end face of the handling head 34 of the hollow rod 33; accordingly, by tightening the screw 37, the object support 22, the hollow rod 33 and the washers 31, 32 are fastened together.

Clearly it is sufficient to turn the hollow rod 33 relative to the hollow screw 35, which is fixed relative to the plate 11, to alter the vertical position of the object support 22; the screw 37 is tightened to lock the object support in this position.

Three devices like that just described advantageously ensure that the top face 23 of each object support 22 is perpendicular to the rotation axis of the plate 11.

A suction head is provided under each object support 22 to retain the thin objects that it carries. This is known in the art. The suction head 39 (FIG. 5) is fastened to the bottom of the object support 22 by means of a screwthread 29 which opens into the suction recess 28; the suction head 39 passes through the plate 11 with clearance in a bore 38 provided for this purpose in the plate 11.

Of course, when there is a support plate 40, as in this example, it has holes for retaining the object 30 that it supports by suction.

According to an important feature of the present invention the object support 22 and the plate 11 have respective and aligned holes 41 and 42 (FIGS. 4 and 6) through them in which slide two tubes 43; the length of the tubes 43 is such that they can emerge above the surface 23 of the object support 22 and below the bottom face of the plate 11. Of course, the support plate 40 also has holes through it through which the tubes 43 pass.

The lower ends of the tubes 43 which emerge under the plate 11 are fastened to a spacer 44 carrying a roller 45 at its bottom end; the spacer 44 is fastened to a skid 46, of the ball type, for example, adapted to cooperate sliding fashion with a guide rail 47 fixed to the bottom of the object support 22 and passing through an opening 48 in the plate 11.

The roller 45 is adapted to cooperate with a fixed cam 50 extending circumferentially under the plate 11.

The cam 50 (FIGS. 6 to 8) carries an end arm 51 whose end includes a lifting ramp in the form of an inclined plane 52; the inclined plane 52 is narrow so that a right-angle cut-out 53 is defined at the end of the end arm 51; the right-angle corner of a shoe 54 attached to the head of an actuator 60 carried by a baseplate 61 fastened to the frame 12 of the machine slides vertically in the cut-out 53.

The shoe 54 has at the end opposite that cooperating with the cut-out 53 a lifting ramp 55 in the form of an inclined plane 55 parallel to the inclined plane 52 of the cam 50.

The inclined plane 55 of the shoe 54 extends the full width of the shoe 54, which is very much greater than that of the inclined plane 52 of the cam 50, and also greater than that of the cam 50.

Figure 3:
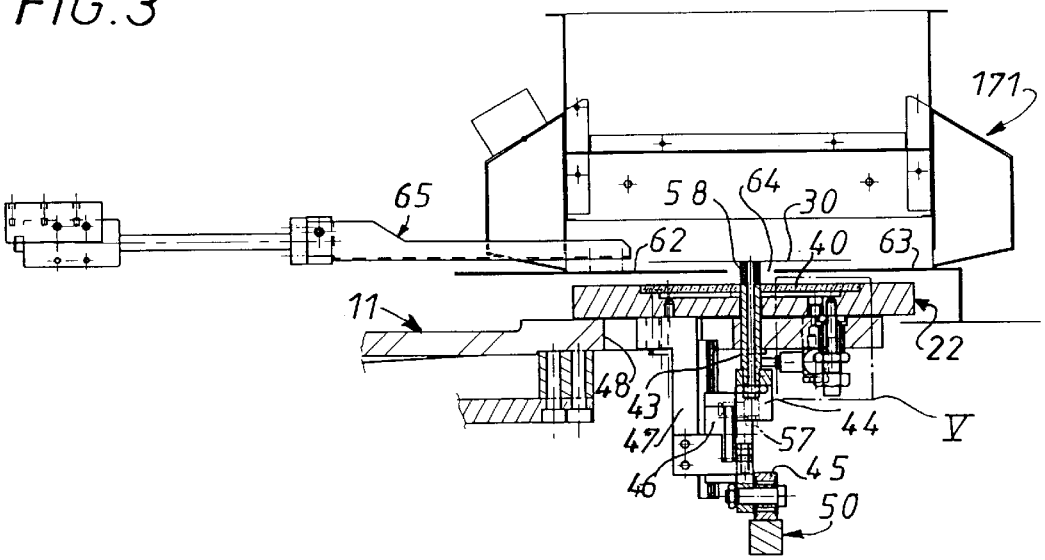
FIG. 3 is a view partly in section of a heat treatment station.
Figure 4:
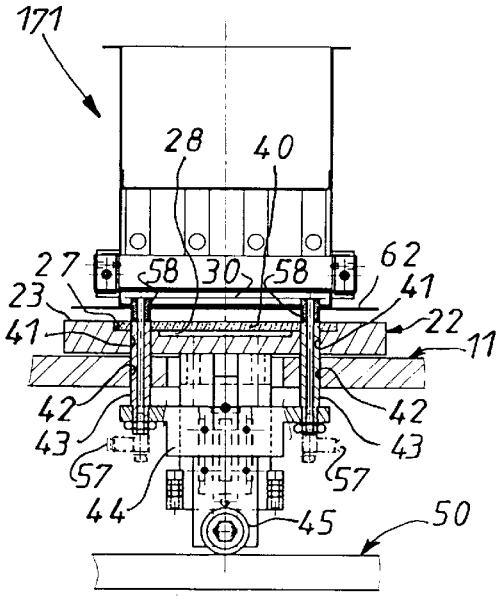
FIG. 4 is a side view relative to FIG. 3 and shows the object support raised.
Figure 5:
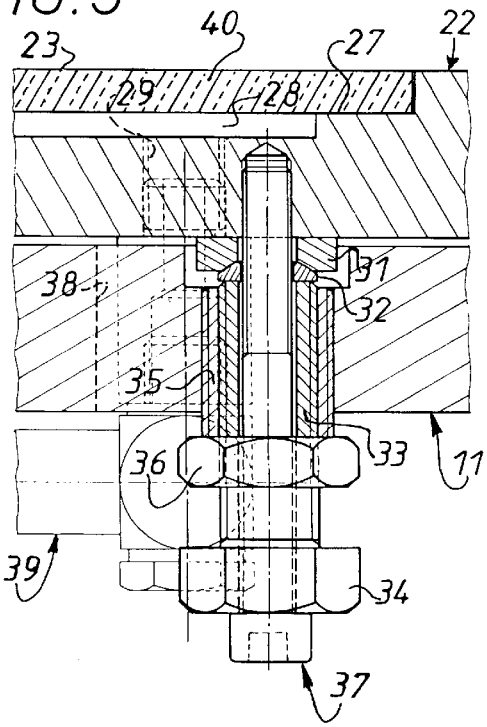
FIG. 5 is a view to a larger scale of the bubble V in FIG. 3.
Figure 6:
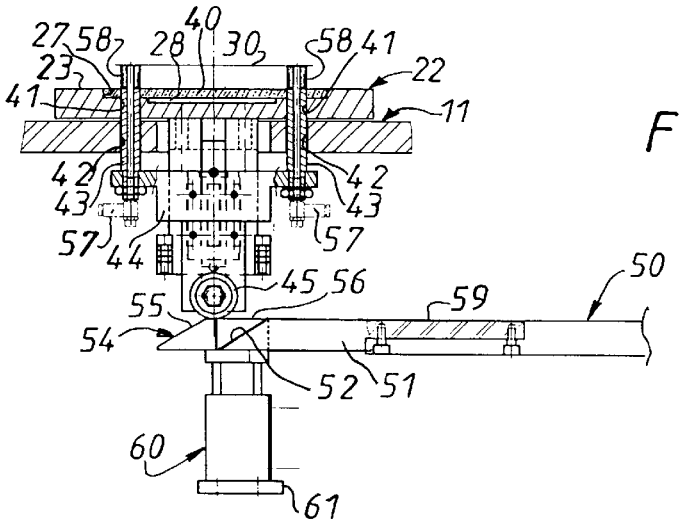
FIG. 6 is a view partly in section analogous to that of FIG. 4 and shows the raising of the object support.

Beyond its inclined plane 52, the top face 59 of the cam 50 extends in a plane perpendicular to the axis of the machine and constitutes a bearing surface for holding the spacer 44 in the raised position (FIGS. 3 and 4).

The cam 50 extends circumferentially in line with the batteries 17, 18, 19; the machine 50 therefore comprises three cams 50.

The inclined plane 55 of the shoe 54 is followed by a top face 56 which is vertically aligned with the top face 59 of the cam 50 when the shoe 54 is in the position to which it is raised by the actuator 60 (FIG. 6), with the top face 56 of the shoe 54 also perpendicular to the axis of the machine.

When the shoe 54 is in the bottom position (FIG. 8) and the roller 45 is bearing on the top face 56 of the shoe 54, the tubes 43 do not emerge from the top face 23 of the object support 22, their end face being at most in the plane of the top face 23.

In the rest position, in areas other than those in which the shoes 54 and the cams 50 are present, the assembly made up of the tubes 43, the spacer 44 and the shoe 46 drops under its own weight toward a position defined by an abutment, not shown, and in which the lowest point of the roller 45 is practically level with the top face 56 of the shoe 54 in the bottom position, or slightly below that face 56, and in all cases above the lowest point of the inclined plane 52 of the cam 50.

Clearly, when the spacer 44 is in its top position (FIGS. 3, 4 and 6), the ends of the tubes 43 lift the object 30, which is then at a vertical distance from the object support 22 carrying it and therefore at a vertical distance from the plate 11.

The tubes 43 are connected to suction heads 57 to preserve the position of the object 30 relative to the object support 22.

It is advantageous to provide, as in this example, the ends of the tubes 43 with an endpiece 58 made from a material that is resistant to very high temperatures, such as a fluorinated plastics material, for example.

The operation of the object supports 22 follows from the above description; after printing, the sequence is such that the roller 45 of the object support 22 concerned is placed at the entry of the top face 56 of the shoe 54 of the actuator 60 upstream of the heat treatment stations (FIG. 8), with or without the aid of the inclined plane 55 of the shoe 54; the suction nozzles 57 are energized and the actuator 60 is operated so that the tubes 43 lift the object 30, because the roller 45 is then at the height of the position maintaining bearing surface 59 of the cam 50 (FIG. 6); as the plate 11 turns, the roller rolls on the position maintaining bearing surface 59, which holds the object 50 in the raised position; at the end of the treatment the position maintaining bearing surface 59 is interrupted, all the raised parts descend, and the object 30 comes back into contact with the top face 23 of the object support 22; the descent of all the raised parts can if required be controlled by having the bearing surface 59 follow a descending ramp.

Figure 7:
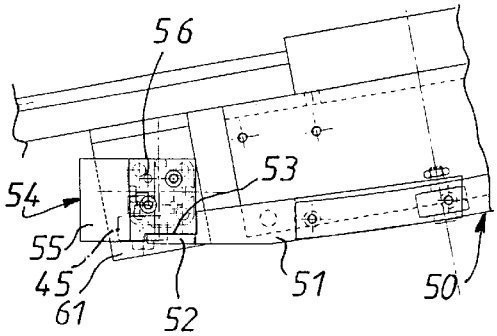
FIG. 7 is a plan view of the lifting means from FIG. 6 to a larger scale.
Figure 8:
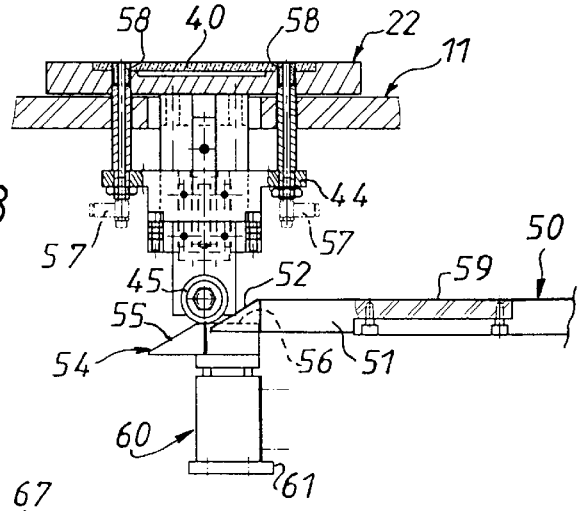
FIG. 8 is analogous to FIG. 6 and shows the object support at rest, before it is raised.

As shown in dashed outline in FIG. 7, the roller 45 is radially disposed so that it is in part in line with the inclined plane 52 of the cam 50; thanks to this arrangement, should the actuator 60 be inoperative for any reason, the plate 11, in turning, would drive the object support 22, and its roller 45 would then be caused to climb said inclined plane 52, so raising the assembly and therefore the object 30.

In this position of the object 30, as already stated, the heat flux of the heat treatment station has no or very little effect on the object support 22 and the plate 11.

Further heat protection can be provided, if necessary.

In this example, two fixed screens 62, 63 (FIGS. 3 and 4) are disposed in line with the heat treatment stations; they are halfway up the emergent travel of the tubes 43 and at a radial distance from each other so that a slot 64 is formed which extends in the circumferential direction and through which the tubes 43 pass in the raised position; accordingly, during heat treatment, the object 30 is above said screens 62, 63, as can be seen in the figures.

If there is no object to be treated, it is preferable to cover the slot 64 to prevent heat escaping through it; to this end a slot cover 65 is provided and can be moved radially between two positions, namely a rest position (FIG. 3) in which the slot cover 65 is at a radial distance from the slot 64 and from the object 30 to be treated and an operational position in which the slot cover 65 covers the slot 64.

Thus at rest, i.e. during sequences in which there are no objects to be heat treated, the slot 64 is covered by the slot cover 65; during treatment the slot cover 65 is moved radially and the slot 65 is uncovered, allowing the tubes 43 to pass through, but is masked by the object 30; if the instruction to uncover the slot 65 were not executed, the tubes 43 would impact on the slot cover 65 and destroy it, but it is easily replaceable.

Thanks to the invention, by virtue of which the object 30 is raised relative to the object support 22, it is possible to provide a station 19 for turning over the object 30.

Figure 9:
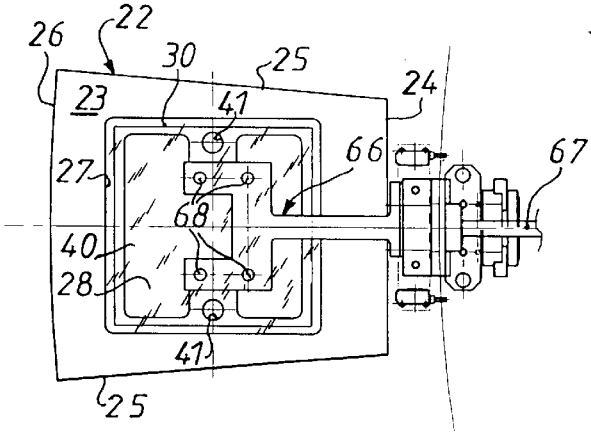
FIG. 9 is a partial plan view of an overturning station.

Accordingly, a pallet 66 (FIG. 9) which has a forked end in this example is associated with actuator means adapted to move the pallet 66 vertically and horizontally, here radially, and to turn it about its axis 67; the pallet 66 has suction nozzles 68 at its end, four suction nozzles in this example, for holding the object 30; the width of the pallet 66 measured in the circumferential direction is less than the circumferential distance between the holes 41 in the object support 22, and thus the tubes 43, so that it is sufficient to insert the pallet 66 radially into the space between the object support 22 and the object 30 when the latter has been raised by the tubes 43 and to raise the pallet 66 vertically, which entrains with it the object 30 that is fastened to the pallet 66 by the suction nozzles 68; the pallet 66 is then raised vertically a sufficient distance to enable the object 30 to be turned 180°; the tubes 43 are retracted while the object is being turned over; the pallet 66 is then lowered and places the object 30 on the object support 22.

What is claimed is:

1. A printing machine including a plate adapted to rotate about its axis and carrying at its periphery a plurality of object supports having a top face adapted to receive an object to be printed and a plurality of workstations distributed circumferentially around said plate in line with the trajectory of said object supports and some of which are printing stations and others of which are treatment stations, wherein at least one of said object supports includes lifting means adapted to raise said object relative to the top face of said object support and said lifting means are connected to a suction head adapted to preserve a projecting position of said object corresponding to that it initially occupied on said object support.

2. The printing machine claimed in claim 1, wherein said lifting means include at least one tube mounted to slide through holes through said object support and said plate.

3. The printing machine claimed in claim 2 wherein said tube is fastened at the bottom to a spacer fastened to a shoe adapted to cooperate slidingly with a guide rail fixed under said object support and passing through an opening in said plate.

4. The printing machine claimed in claim 3 wherein said spacer is adapted to cooperate with fixed cam means carried by a frame of said machine having a lifting ramp and a raised position maintaining bearing surface.

5. The printing machine claimed in claim 4 wherein said spacer cooperates with said cam means and/or said shoe via a roller.

6. The printing machine claimed in claim 4 wherein said spacer is adapted to cooperate with the shoe of a lifting actuator and with a raised position maintaining bearing surface formed on the top of fixed cam means carried by a frame of said machine and the width of said lifting ramp of said cam means is less than that of its position maintaining bearing surface whereby a cut-out is defined in which said shoe of said actuator slides.

7. The printing machine claimed in claim 3 wherein said spacer is adapted to cooperate with the shoe of a lifting actuator and with a raised position maintaining bearing surface formed on the top of fixed cam means carried by a frame of said machine.

8. The printing machine claimed in claim 7 wherein said shoe includes a lifting ramp.

9. The printing machine claimed in claim 2, wherein at least one of said treatment stations is a heat treatment station and the end of said tube has an endpiece made from a material that is resistant to high temperatures.

10. The printing machine claimed in claim 2, wherein at least one of said treatment stations is a heat treatment station and said heat treatment station is a high-temperature station at which there are two radially spaced screens defining a slot through which said tube passes in the raised position, said screens being halfway up the emergent travel of said tube.

11. The printing machine claimed in claim 10 including a slot cover adapted to cover said slot during phases in which there are no objects to be treated.

12. The printing machine claimed in claim 2, wherein at least one of said treatment stations is a heat treatment station, the end of said tube has an endpiece made from a material that is resistant to high temperatures and said heat treatment station is a high-temperature station at which there are two radially spaced screens defining a slot through which said tube passes in the raised position, said screens being halfway up the emergent travel of said tube.

13. The printing machine claimed in claim 12 including a slot cover adapted to cover said slot during phases in which there are no objects to be treated.

14. The printing machine claimed in claim 3 wherein said lifting means comprise two sliding tubes.

15. The printing machine claimed in claim 1, wherein at least one of said treatment stations is a heat treatment station.

16. The printing machine claimed in claim 1, wherein at least one workstation is an overturning station.

17. The printing machine claimed in claim 16 wherein said overturning station includes a pallet associated with actuator means adapted to move said pallet vertically and radially and to turn it about an axis.

18. The printing machine claimed in claim 17 wherein said pallet has holding suction nozzles at the end.

19. The printing machine claimed in claim 17 wherein said actuator means are adapted to insert said pallet radially into the space between said object support and said object when said object is raised by said lifting means.

20. The printing machine claimed in claim 1, wherein said object supports are adjustably mounted on said plate.

21. The printing machine claimed in claim 20 wherein said object support bears on a hollow rod which is externally screwthreaded and screwed into a screwthread of said plate and a screw screwed into said object support passes through said hollow rod.

22. The printing machine claimed in claim 21 wherein said screwthread of said plate is an internal screwthread of a hollow screw surrounding said rod and screwed into said plate by means of a screwthread on its outside face.

* * * * *